US007320513B2

(12) United States Patent
Kim et al.

(10) Patent No.: US 7,320,513 B2
(45) Date of Patent: Jan. 22, 2008

(54) BUBBLE-INK JET PRINT HEAD AND FABRICATION METHOD THEREOF

(75) Inventors: Yun-gi Kim, Yongin (KR); Yong-shik Park, Seongnam (KR); Sung-joon Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 218 days.

(21) Appl. No.: 10/751,467

(22) Filed: Jan. 6, 2004

(65) Prior Publication Data

US 2004/0155943 A1 Aug. 12, 2004

(30) Foreign Application Priority Data

Feb. 7, 2003 (KR) ..... 10-2003-0007935

(51) Int. Cl.
*B41J 2/05* (2006.01)

(52) U.S. Cl. ..... 347/65

(58) Field of Classification Search ..... 347/54, 347/56, 61, 65, 67
See application file for complete search history.

(56) References Cited

U.S. PATENT DOCUMENTS 4,882,595 A * 11/1989 Trueba et al. ..... 347/85
5,387,314 A * 2/1995 Baughman et al. ..... 216/27
6,412,921 B1 * 7/2002 Manini ..... 347/65
6,540,337 B1 * 4/2003 Pollard ..... 347/65
6,561,632 B2 * 5/2003 Feinn et al. ..... 347/65

FOREIGN PATENT DOCUMENTS

| | | | |
|---|---|---|---|
| CN | 1245753 A | | 3/2000 |
| JP | 06-238904 | | 8/1994 |
| JP | WO 00/00354 | * | 1/2000 |
| JP | 2000-225708 | | 8/2000 |

* cited by examiner

*Primary Examiner*—Stephen Meier
*Assistant Examiner*—Geoffrey S. Mruk
(74) *Attorney, Agent, or Firm*—Staas & Halsey LLP

(57) ABSTRACT

A bubble-ink jet print head includes: a substrate having ink chambers to store ink and resistance heat emitting bodies to heat ink disposed thereover; and an ink supply passage which penetrates the substrate and which is connected with the ink chambers. The ink supply passage includes: a first trench formed at a first surface of the substrate in a first pattern having a separating distance from at least one of inlets of the ink chambers and connecting portions between the adjacent ink chambers, the first surface of the substrate having the ink chambers disposed thereover, and a second trench formed at a second surface of the substrate in a second pattern, having one of an area equal to and an area smaller than that of the first trench in the range of the first pattern of the first trench, and in communication with the first trench.

3 Claims, 13 Drawing Sheets

BUBBLE-INK JET PRINT HEAD AND FABRICATION METHOD THEREOF

CROSS-REFERENCE TO RELATED APPLICATIONS

This application claims the priority of Korean Patent Application No. 2003-7935, filed on Feb. 7, 2003, in the Korean Intellectual Property Office, the disclosure of which is incorporated herein in its entirety by reference.

BACKGROUND OF THE INVENTION

1. Field of the Invention

The present invention relates to a print head of an ink jet printer and a fabrication method thereof, and more particularly, to a bubble-ink jet print head and a fabrication method thereof, having an ink supply opening which improves the uniformity of the ink injection characteristics of respective injection nozzles, thereby assuring that the amounts of ink supplied to or jetted through respective injection nozzles even though the injection nozzles are highly integrated.

2. Description of the Related Art

Since an ink-jet printer is excellent in prevention of noise and in obtaining a high resolution and it is also capable of performing a color printing at a low cost, a consumer's demand for the ink jet printer has been increased.

Also, with the development of the semiconductor technology, print head fabrication technology, which is a main component of the ink jet printer, has been actively developed for the past decade. As a result, a print head having about 500 to 1,000 injection nozzles and capable of providing a resolution of 1200 dpi is currently being used in disposable ink cartridges.

FIG. 1 schematically shows a conventional print head 10 for an ink jet printer.

Generally, ink is supplied from a back surface of a substrate 1 of the print head 10 to a front surface of the substrate 1 through a first ink supply channel 2 composing an ink supply opening connected with an ink cartridge (not shown).

The ink supplied through the first ink supply channel 2 flows along restrictors or second ink supply channels 3 defined by a chamber plate 8 and a nozzle plate 9 to reach ink chambers 4. The ink temporarily stagnating in the ink chambers 4 is instantly boiled by a heat generated from heaters 6 disposed under a protective layer 5.

As a result, the ink generates an explosive bubble and, due to the bubble, some of the ink in the ink chambers 4 is discharged outwardly from the print head 10 through injection nozzles 7 formed above the ink chambers 4.

In such a print head 10, shape and disposition of the first and second ink supply channels 2, 3 and the ink chambers 4 are important factors that affect an ink flow and a frequency characteristic of unit nozzle.

For example, as shown in FIGS. 2 and 3, the frequency characteristic of unit nozzle is greatly influenced by a distance SH from the first ink supply channel 2 to inlets of the ink chambers 4 or connecting portions 4' between the adjacent ink chambers 4.

More specifically, the smaller the width of the second ink supply channels 3 is formed, i.e., the closer the edge of the first ink supply channel 2 is positioned to the ink chambers 4, the better the ink supply performance of the injection nozzles 4 is, and thereby the frequency characteristic of unit nozzle can be improved.

Also, when fabricating a print head having above 500 injection nozzles 7, in order to obtain a superior scattering characteristic in ink jetting, the print head 10 should be fabricated to ensure that the distance SH from the first ink supply channel 2 to the respective ink chambers 4 is uniformly maintained.

Accordingly, the shape and disposition of the first and second ink supply channels 2, 3 and the ink chambers 4 are designed to ensure that the distance SH from the first ink supply channel 2 to the respective ink chambers 4 is uniformly maintained.

In the print head 10, the first ink supply channel 2 is generally is formed by etching the substrate 1 from the back surface to the front surface thereof through a wet or dry etching process, before or after forming the chamber plate 8 and the nozzle plate 9 or an one body chamber/nozzle plate (not shown) over the substrate 1 having the heaters 6 and switching elements such as transistors formed thereover.

However, the related art is not without problems. For example, if the first ink supply channel 2 is formed by a wet etching process of using a strong alkaline etch resolution such as Tetra-methyl-ammonium Hydroxide (TMAH), it requires that the front and the back surfaces of the substrate 1, except for a portion to form the first ink supply channel 2, should be masked by a layer of anti-undercut material and oxide or nitride having a high etch selectivity ratio to the strong alkaline etching resolution before performing the wet etching process, and removed the masking material to ensure that remnants thereof do not remain along the first ink supply channel 2 after performing the wet etching process.

Further, if the first ink supply channel 2 is formed by a dry etching process of using a sandblaster, it is possible that the edge of the first ink supply channel 2 is not only uncleanly formed as shown in FIG. 4, but also the heaters 6 and the switching elements are contaminated due to particles generated during sandblasting.

Also, if the first ink supply channel 2 is formed by a silicon dry etching process using an etch gas, since a protective layer 5 such as oxide or nitride having a high etch selectivity ratio to the etch gas is used as an etch stop layer over the front surface of the substrate 1, as shown in FIGS. 5A and 5B, lateral etching is generated due to charging phenomenon at the interface between the protective layer 5 and the substrate 1 thereby to unevenly form notches 2' which are remained even after the protective layer 5 is etched and removed, so that first ink supply channel 2 is not regulated in a precise measure.

When the notches 2' are unevenly formed as explained above, the flow of ink supplied to the injection nozzles 7 via the second ink supply channels 3 and the ink chambers 4 through the first ink supply channel 2 becomes uneven, thereby resulting in a non-homogenous frequency characteristic of unit nozzle.

SUMMARY OF THE INVENTION

Additional aspects and/or advantages of the invention will be set forth in part in the description which follows and, in part, will be obvious from the description, or may be learned by practice of the invention.

The present invention has been developed in order to solve the above and/or other problems in the related art.

Accordingly, an aspect of the present invention is to provide a bubble-ink jet print head and a fabrication method thereof, having a first ink supply channel which can correctly and uniformly form a flow channel of ink supplied to injection nozzles through second supply channels and ink chambers from the first ink supply channel connected with an ink cartridge, to improve uniformity in ink injection characteristics of respective injection nozzles and thereby to assure amounts of ink supplied to or jetted through the respective injection nozzles to be the same with each other even though the injection nozzles are highly integrated.

Another aspect of the present invention is to provide a bubble-ink jet print head and a fabrication method thereof, having a first ink supply channel which is formed by etching two trenches having sizes different from each other through a dry and/or a wet etching processes at front and back surfaces of a substrate to improve a drop in measure accuracy due to notches generated when forming the first ink supply channel through only the dry etching process or the wet etching process at the back surfaces of the substrate.

Further another aspect of the present invention is to provide a bubble-ink jet print head and a fabrication method thereof, having a first ink supply channel which can compensate measure error in etching of an inlet of the first ink supply channel and also enlarge process margin, by making an outlet of the first ink supply channel previously formed at a front surface of a substrate to have an area larger than that of the inlet of the first ink supply channel later formed at a back surface of a substrate.

Still further another aspect of the present invention is to provide a bubble-ink jet print head and a fabrication method thereof, having a first ink supply channel which can improve efficiency and uniformity in ink jetting, by forming an outlet of the first ink supply channel closely to ink chambers at a front surface of a substrate.

Also another aspect of the present invention is to provide a bubble-ink jet print head and a fabrication method thereof, having a first ink supply channel which can prevent ink from being leaked in printing by reducing a size of an inlet of the first ink supply channel formed at a back surface of a substrate to enlarge a contact area between the substrate and an ink cartridge.

The other aspect of the present invention is to provide a bubble-ink jet print head and a fabrication method thereof, having a first ink supply channel which can be applied to both a fabrication method of a print head employing a monolithic method and a fabrication method of a print head employing an adhering method.

According to an aspect of the present invention, there is provided a bubble-ink jet print head including: a substrate having ink chambers to store ink and resistance heat emitting bodies to heat ink disposed thereover; and an ink supply passage which penetrates the substrate and which is connected with the ink chambers. The ink supply passage includes a first trench formed at a first surface of the substrate in a first pattern having a separating distance from at least one of inlets of the ink chambers and connecting portions between the adjacent ink chambers, the first surface of the substrate having the ink chambers disposed thereover, and a second trench formed at a second surface of the substrate in a second pattern, having one of an area equal to and an area smaller than that of the first trench in the range of the first pattern of the first trench, and in communication with the first trench.

The first trench may have a depth from 5 μm to 20 μm.

According to another aspect of the present invention, there is provided a fabrication method of a bubble-ink jet print head including forming a first trench at a first surface of a substrate by an etching process to communicate with ink chambers to be formed later; and forming a second trench at a second surface of the substrate by a dry etching process to communicate with the first trench. The first and the second trenches comprise an ink supply passage penetrating the substrate.

The forming of the first trench may include: forming an etch mask for forming the first trench over the first surface of the substrate; etching the first surface of the substrate by one of a wet etching process and a dry etching process using the etch mask; and removing the etch mask.

The etch mask may be one of a pattern by which first trench is separated by a distance ranging from 1 μm to 5 μm from at least one of inlets of the ink chambers and connecting portions between the adjacent ink chambers. A shape of the first etch mask may comprise a closed curve spaced apart from the outline of the ink chambers, irrespective of a coordinate disposition of injection nozzles.

The etch mask may be formed of one of a silicon nitride, nitride, photo resist, epoxy resin, and metal.

The dry etching process may yield a depth ranging from 5 μm to 20 μm and may use one of $SF_6$ gas, $CF_3$ gas, and $CHF_3$ gas as an etch gas, and the wet etching process may yield a depth ranging from 5 μm to 20 μm and may use as an anisotropic etch solution one of a TMAH and a KOH.

The forming of the second trench may include forming an etch mask for forming the second trench on the second surface of the substrate; etching the second surface of the substrate by a dry etching process using the etch mask; and removing the second etch mask.

The etch mask may have a pattern having one of an area equal to and an area smaller than that of the first trench.

The etch mask may be one of a silicon nitride, nitride, photo resist, epoxy resin, and metal. The dry etching process may use one of $SF_6$ gas, $CF_3$ gas, and $CHF_3$ gas.

The method may further include forming ink chambers and injection nozzles over the first surface of the substrate between the forming operations.

The forming of the ink chambers and the injection nozzles may include: forming a photo resist layer over the first surface of the substrate; forming a chamber plate by patterning the photo resist layer through a photolithography process of using a mask in which respective flow channel structures of the ink chambers and the ink supply channels which composes restrictors are patterned; forming a dry film resist layer on the chamber plate; and forming a nozzle plate by patterning the dry film resist layer through a photolithography process of using a mask in which a structure of the injection nozzles is patterned.

The forming of the ink chambers and the injection nozzles may include forming a first photo resist layer over the first surface of the substrate; forming a photo resist mold by patterning the first photo resist layer through a photolithography process; forming a second photo resist layer over the first surface of the substrate over which the photo resist mold is formed; and patterning the second photo resist layer through a photolithography process of using a mask in which a structure of the injection nozzles is patterned. Thereafter, the photo resist mold may be removed.

The method may further include forming the ink chambers and injection nozzles over the first surface of the substrate after the step of forming the second trench.

The forming of the ink chambers and the injection nozzles may include: forming a dry film resist layer over the first surface of the substrate; forming a chamber plate by patterning the dry film resist layer through a photolithography process of using a mask in which a flow channel structure of the ink chambers and the ink supply channels comprising restrictors is patterned; and adhering one of a nozzle plate being made of a photo resist and so on and a nozzle plate being made of a polyimide film on the chamber plate with a heat and a pressure, the nozzle plate being made of the photo resist and so on being fabricated by an electrolytic deposition of using a substrate having a mandrel and the nozzle plate of the polyimide film being fabricated to have nozzles formed therein by a laser ablation.

According to still another aspect of the present invention, there is provided an ink-jet printhead, including: a substrate; at least one heater formed on a top surface of the substrate which heats ink disposed; an ink chamber disposed at least partially over the at least one heater; and an ink supply opening extending through the substrate, the ink passage in fluidic communication with the ink supply chamber and the ink chamber. The ink supply opening includes a first trench formed at an ink chamber side of the substrate in a first pattern having a separated distance from at least one of inlets of the ink chambers and connecting portions between the adjacent ink chambers, and a second trench formed at a second surface of the substrate in a second pattern having one of an area equal to and an area smaller than that of the first trench in the range of the first pattern of the first trench, to communicate with the first trench.

According to yet another aspect of the present invention, there is provided a bubble-jet print head fabrication method including providing an ink supply opening by: forming a first trench at a first surface of a substrate by an etching process to communicate with at least one ink chamber to be formed later; and forming a second trench at a second surface of the substrate by a dry etching process to communicate with the first trench.

According to yet another aspect of the present invention, there is provided a method of improving measure accuracy degraded due to notches generated when forming an ink supply channel through a substrate by only one of a dry etching process and a wet etching process, including forming a first ink supply channel by etching two trenches having sizes different from each other through the dry and/or the wet etching processes at the front and the back surfaces of a substrate.

According to still another aspect of the present invention, there is provided a method of compensating for measuring errors in an etching of an inlet of an ink supply channel and enlarging a processing margin for such etching, including: forming a first trench at a first surface of a substrate by an etching process to communicate with at least one ink chamber to be formed later; and forming, after forming the first trench, a second trench at a second surface of the substrate by a dry etching process to communicate with the first trench. An area of the first trench opening is larger than that of the second trench opening.

According to still another aspect of the present invention, there is provided a method of preventing ink leakage in a bubble jet print head, including: enlarging a contact area between a substrate and the ink cartridge by forming a first trench at a first surface of a substrate by an etching process to communicate with at least one ink chamber to be formed later; and forming a second trench at a second surface of the substrate by a dry etching process to communicate with the first trench.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
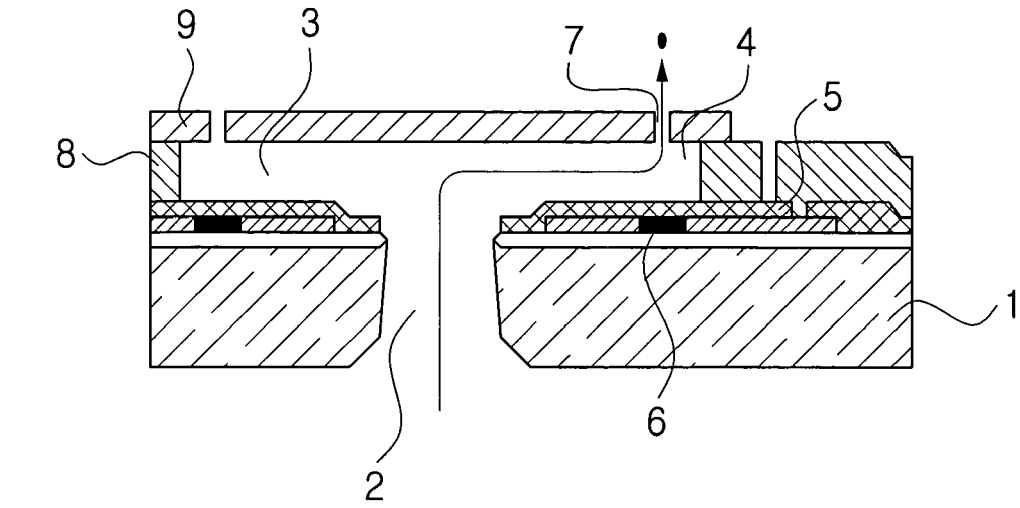
FIG. 1 (PRIOR ART)
FIG. 1 is a cross sectional view showing a conventional print head.
Figure 2:
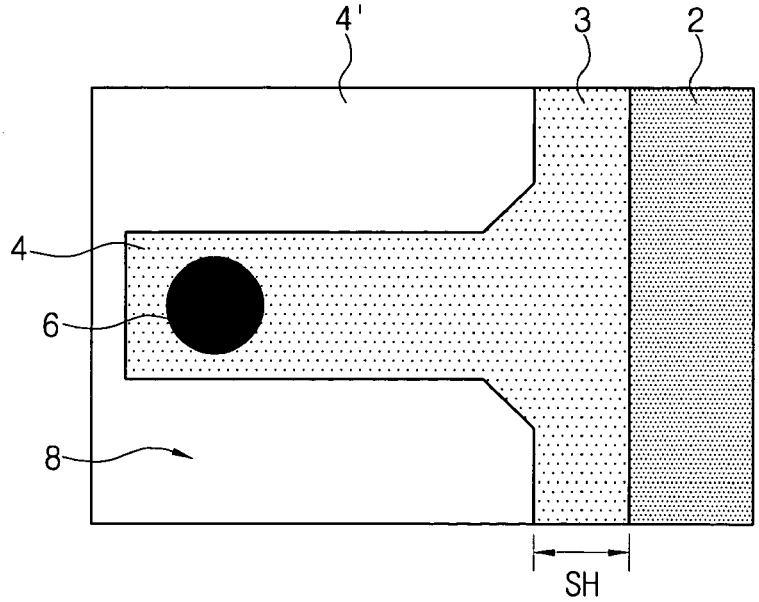
FIG. 2 (PRIOR ART)
FIG. 2 is a top plan view of the print head shown in FIG. 1, showing a unit ink chamber and a first ink supply channel.
Figure 3:
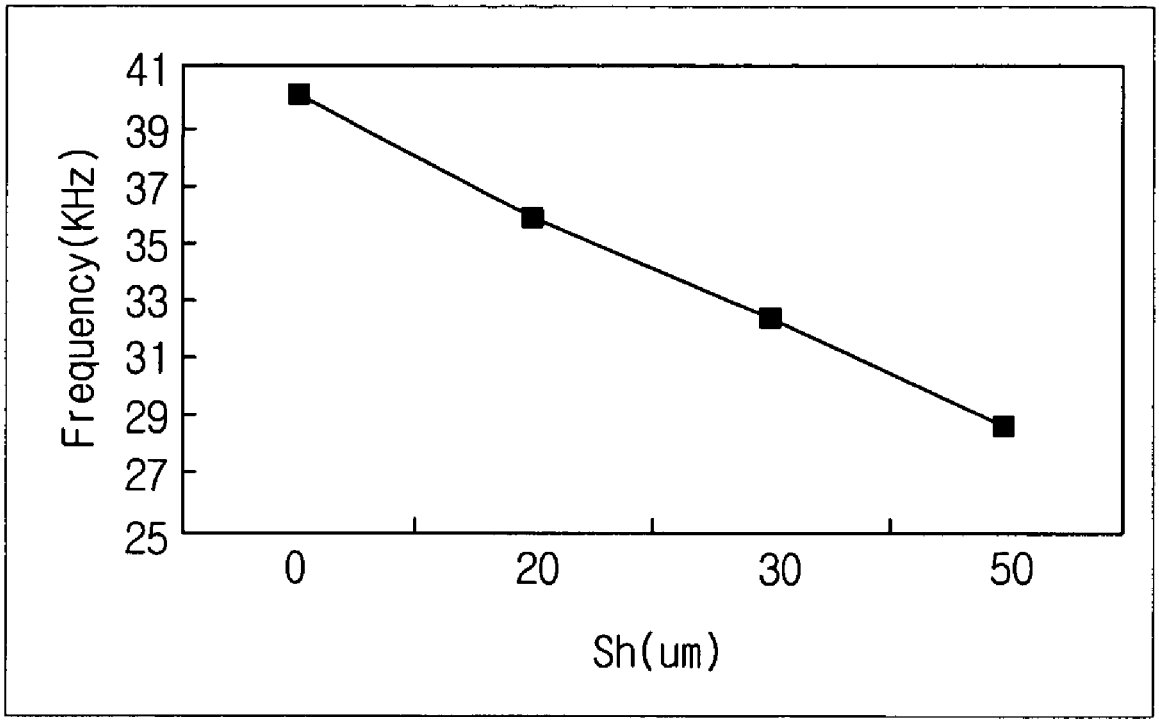
FIG. 3 (PRIOR ART)
FIG. 3 is a graph showing the relation between a frequency characteristic of a unit injection nozzle and a distance between the first ink supply channel and the ink chamber.
Figure 4:
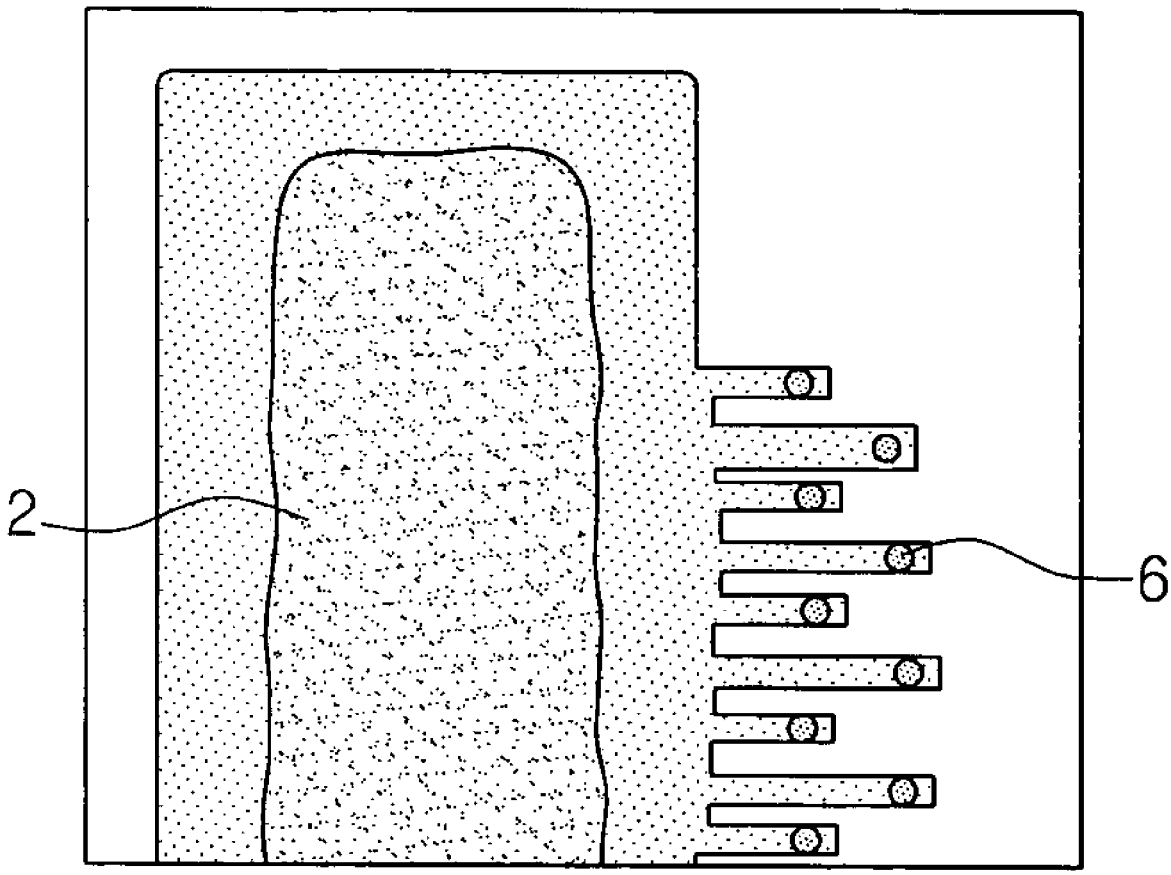
FIG. 4 (PRIOR ART)
FIG. 4 is a photograph showing an edge portion of a first ink supply channel of a print head fabricated by a dry etching process of using a sandblaster.
Figure 5A:
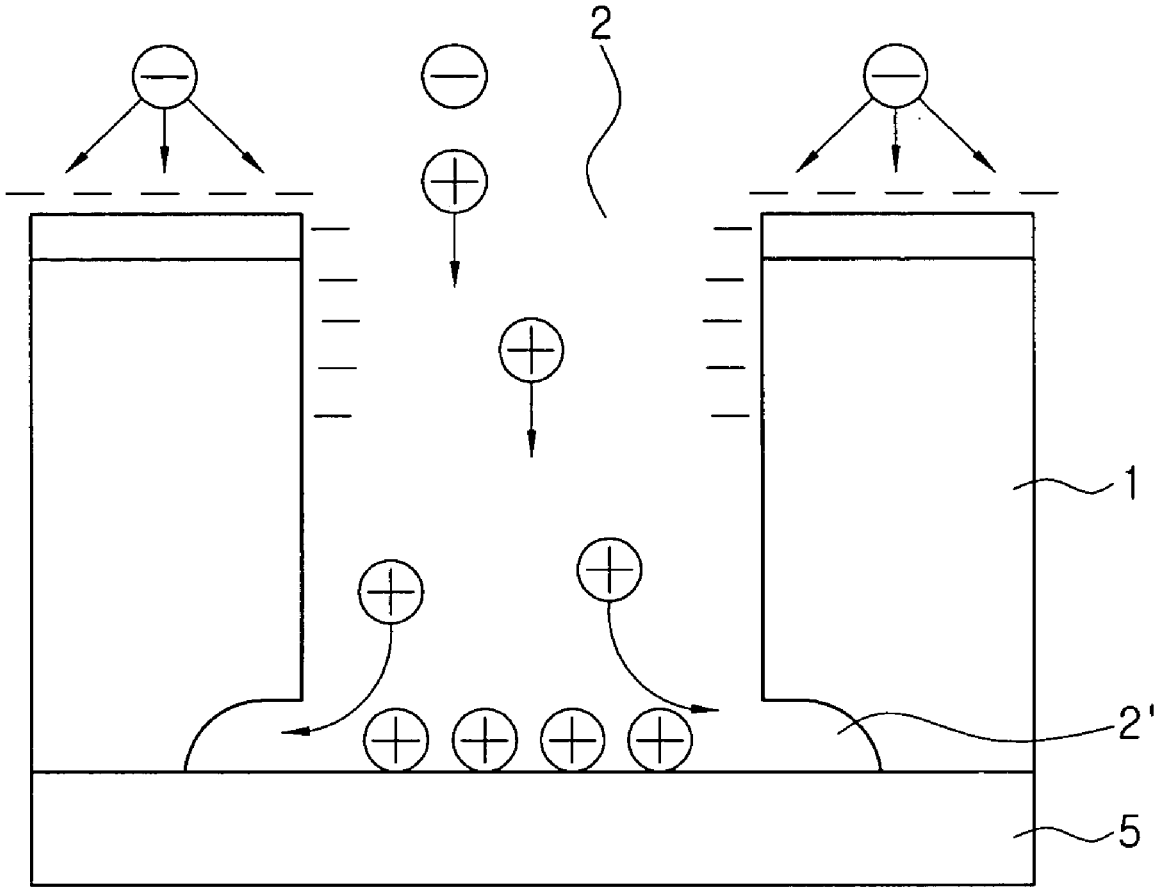
FIG. 5A (PRIOR ART)
FIGS. 5A and 5B are a cross sectional view and a photograph showing a notch phenomenon generating during a general dry etching process.
Figure 5B:
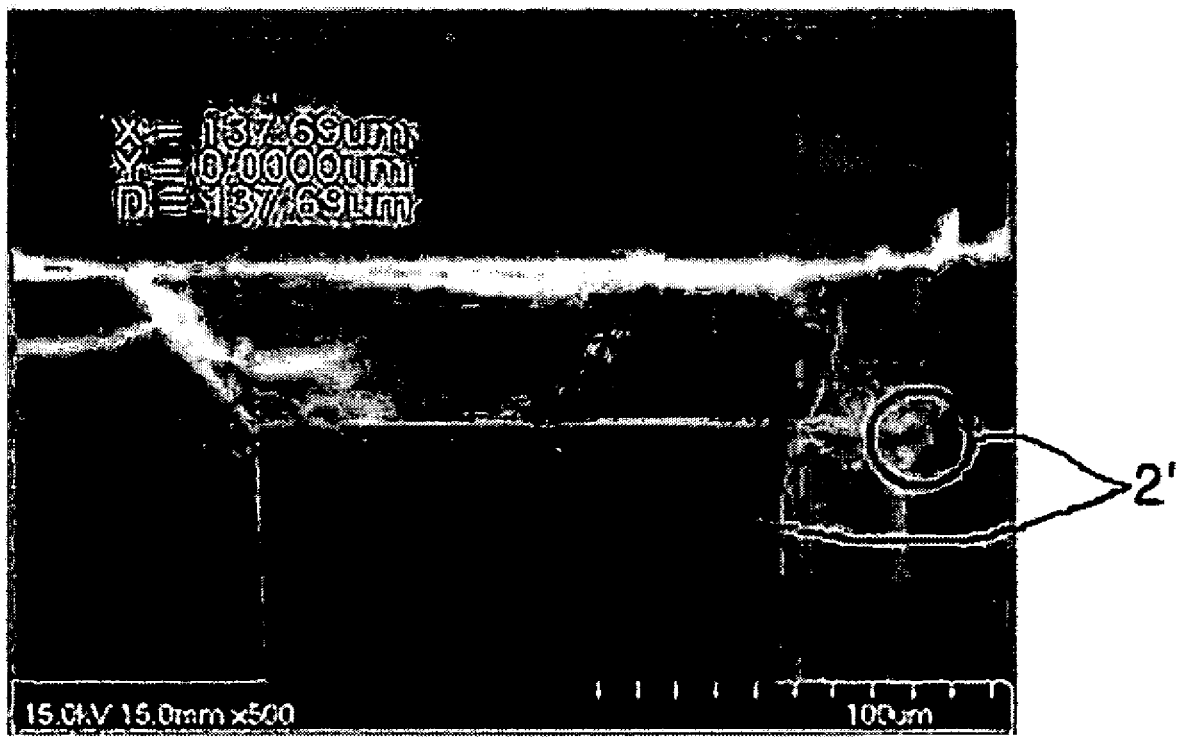
FIG. 5B (PRIOR ART)

Reference will now be made in detail to embodiments of the present invention, examples of which are illustrated in the accompanying drawings, wherein like reference numerals refer to the like elements throughout. The embodiments are described below to explain the present invention by referring to the figures.

EMBODIMENT 1

Figure 6A:
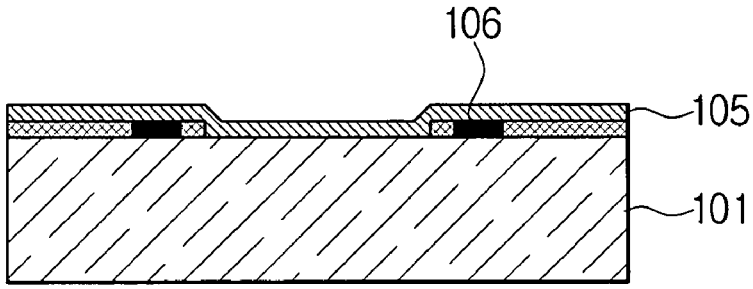
FIGS. 6A through 6F are views showing a process of fabricating a bubble-ink jet print head in accordance with a first embodiment of the present invention.
Figure 6B:
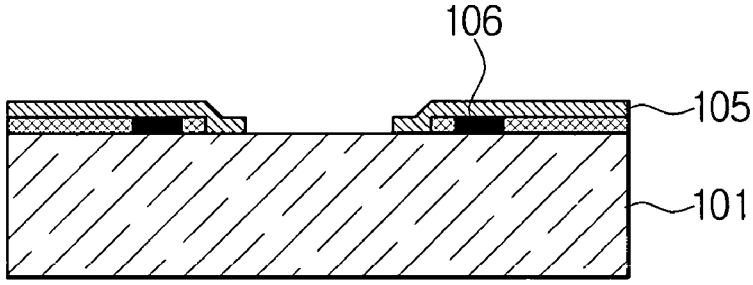
Figure 6C:
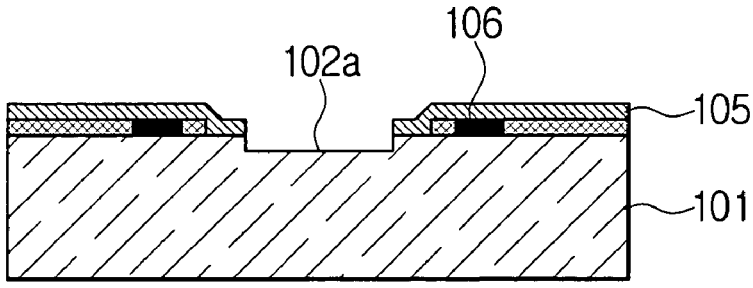
Figure 6D:
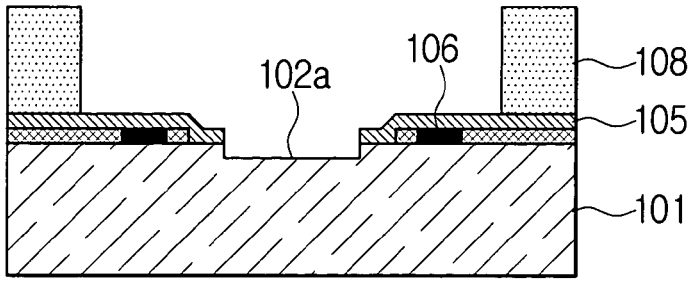
Figure 6E:
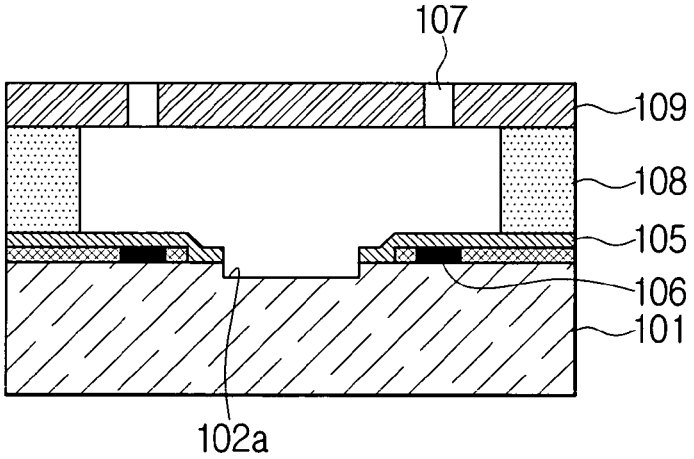
Figure 6F:
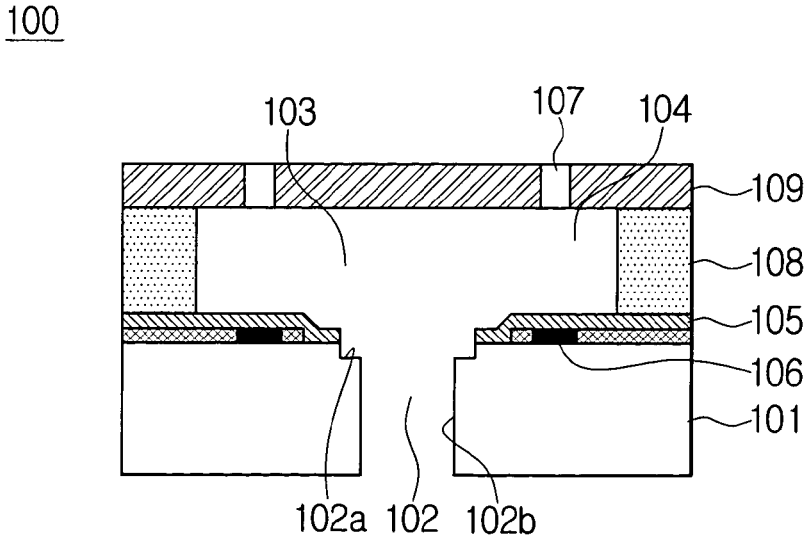

FIG. 6F shows a bubble-ink jet print head 100 according to a first embodiment of the present invention fabricated by a monolithic method.

The print head 100 of this embodiment includes a silicon substrate 101 of 500-800 μm in thickness having a plurality of heaters 106 to heat ink, switching elements (not shown) such as transistors, and a protective layer 105 to protect the heaters and the switching elements formed over it; a first ink supply channel 102 constituting an ink supply opening formed to penetrate the substrate 101; a chamber plate 108 formed on the protective layer 105 by patterning a photo resist through a photolithography process of using a photo mask in which a flow channel structure of ink chambers 104, second ink supply channels 103 constituting restrictors and so on is patterned; and a nozzle plate 109 formed on the chamber plate 108 by patterning a dry film resist through a photolithography process of using a photo mask in which a structure of injection nozzles 107 is patterned.

The first ink supply channel 102 comprises a first trench 102*a* formed toward a front surface of the substrate 101 over which the ink chambers 104 are positioned, and a second trench 102*b* formed toward a back surface of the substrate 101 connected with an ink cartridge (not shown), to communicate with the first trench 102*a*.

To improve a frequency characteristic of a unit injection nozzle, the first trench 102*a* is formed to have a depth of approximately 5-20 μm and in a first pattern forming a closed curve of which a shape in plan of a unit head has a separated distance SH ranging from 1 μm to 5 μm from connecting portions (not shown) between the adjacent ink chambers 104 and/or inlets of the ink chambers 104 constituting the outline of the ink chambers 104, irrespective of coordinate disposition of injection nozzles 107 and the ink chambers 104 zigzagged or arranged in a straight line, as described below.

The second trench 102*b* is formed to extend the depth of the substrate 101 except for the first trench 102*a*, and in a second pattern having an area equal to or smaller than that of the first trench 102*a* in the range of the first pattern of the first trench 102*a*.

Each of the heaters 106 comprises a resistance heat emitting body made of a metal having high specific resistance, or a doped poly-silicon.

The protective layer 105 on the heaters 106 comprises a passivation layer (not shown) made of silicon nitride, silicon carbide or the like vapor-deposited in a thickness of 0.5 μm by LPCVD, and an anti-cavitation layer (not shown) made of a metallic layer of Ta, TaN, TiN or the like vapor-deposited on the passivation layer to isolate ink.

The chamber plate 108 forms a pattern of the flow channel structure of the ink chambers 104, the second ink supply channels 103 constituting the restrictors and so on, whereas the nozzle plate 109 forms a pattern of the injection nozzles 107.

The pattern of the flow channel structure is formable to have coordinate disposition of the injection nozzles 107 and the ink chambers 104 which is zigzagged or arranged in a straight line according to a resolution or a degree of which the injection nozzles 107 are concentrated or integrated.

The photo resist constituting the chamber plate 108 is formed to have a thickness of approximately 10-100 μm, such as, by way of non-limiting example, 30-40 μm, by a photosensitive polymer of epoxy group such as SU-8, or a polyimide.

A fabrication method of the monolithic bubble-ink jet print head 100 as constructed according to the first embodiment of the present invention will be described in detail with reference to FIGS. 6A through 6F.

Firstly, over a front surface of a silicon substrate 101 are formed switching elements, heaters 106, in a manner known in the art.

At this point, the heaters 106 are generally formed by selectively etching relatively lower resistance metallic layer among thin metallic layers having high and low specific resistances, or by forming a ploy silicon layer in which impurities are doped over the front surface of the silicon substrate 101 and then patterning it.

Next, as shown in FIG. 6A, over the substrate 101 is formed a protective layer 105 to protect the switching elements and the heaters 106.

The protective layer 105 comprises a passivation layer made of silicon nitride, silicon carbide or the like vapor-deposited in a thickness of 0.5 μm by LPCVD, and an anti-cavitation layer made of a metallic layer of Ta, TaN, TiN or the like vapor-deposited on the passivation layer.

Subsequently, to form a shallow first trench 102*a* forming a first portion of first ink supply channel 102, the protective layer 105 of the substrate 101 is thickly coated a first photo resist to form a first photo resist layer (not shown), and the first photo resist layer is exposed to light such as UV and developed by a photolithography process of using a photo mask (not shown) having a first pattern of the first trench 102*a*. As a result, on the protective layer 105 is formed a first trench-etching mask pattern (not shown).

At this point, the first pattern of the first trench 102*a* in the photo mask forms a closed curve of which a shape in plan of a unit head has a separated distance SH ranging from 1 μm to 5 μm from connecting portions (not shown) between the adjacent ink chambers 104 and/or inlets of the ink chambers 104 constituting the outline of the ink chambers 104, irrespective of coordinate disposition of injection nozzles 107 and the ink chambers 104 to be formed in a zigzagged shape or a straight line shape later.

The first trench-etching mask pattern may comprise, for example, of silicon oxide, nitride, epoxy resin film, pure metal film or the like formed by a vapor-depositing or sputtering, instead of the first photo resist layer patterned through the photolithography process.

After forming the first trench-etching mask pattern, the protective layer 105 over the front surface of the substrate 101 is etched by a silicon etching process of using the first trench-etching mask pattern as an etch mask. The silicon etching process can be carried out by one of a dry and a wet etching methods using respectively an etching gas such as $CF_3$ gas, $CHF_3$ or the like and an anisotropic etch solution such as a TMAH and a KOH having an etching selectivity with respect to the protective layer 105.

As a result, as shown in FIG. 6B, only a portion of the front surface of the substrate 101 in which the first trench 102*a* will be formed is exposed.

After that, the exposed portion of the front surface of the substrate 101 is etched by a silicon etching process, such as, by way of non-limiting example, a dry etching method of using the first trench-etching mask pattern as an etch mask. At this time, as an etch gas, a $SF_6$ gas having an etching selectivity with respect to the silicon substrate 101 is used. As a result, as shown in FIG. 6C, at the exposed portion of the front surface of the substrate 101 is formed a shallow, first trench 102*a* having a depth ranging from 5 μm to 20 μm.

While in the present embodiment of the present invention, the first trench 102*a* is explained as formed by forming the first trench-etching mask pattern on the protective layer 105 and then etching the protective layer 105 and the substrate 101 in turn by using the first trench-etching mask pattern as an etching mask, it is to be understood that the first trench 102*a* is formable by removing the first trench-etching mask pattern after etching the protective layer 105 by using the first trench-etching mask pattern as an etching mask, and then etching the substrate 101 by using a separately formed etching mask pattern as an etching mask.

In this case, like as the first trench-etching mask pattern, the separately formed etching mask pattern may comprise one of silicon oxide, nitride, epoxy resin film, pure metal film or the like formed by a vapor-depositing or sputtering, as well as a photo resist layer patterned through a photolithography process.

Also, in the silicon etching process, the protective layer 105 and the substrate 101 are explained as etched respectively by the dry or the wet etching method and the dry etching method, thereby to allow the protective layer 105 and the substrate 101 to be respectively etched by etching methods different from each other, but for convenience of etching, they are etchable in turn by one etching method of the same kind, i.e. one of the dry and the wet etching methods, which only the kind of the etching gas or solution is varied according to the object, i.e. the protective layer 105 and the substrate 101.

In this case, if both the protective layer 105 and the substrate 101 are etched in turn through a wet etching method, the substrate 101 as well as the protective layer 105 are etched by the anisotropic etch solution such as TMAH and KOH having an etching selectivity with respect thereto.

Thereafter, an organic matter flowing into the surfaces of the substrate 101 during the etching process is cleaned and the first trench-etching mask pattern is removed.

Subsequently, a negative photo resist such as SU-8 or polyimide is coated in a thickness of approximately 10-100 μm, and such as 30-40 μm, on the protective layer 105 of the substrate 101 to form a negative photo resist layer (not shown), and the negative photo resist layer is exposed to light such as the UV and developed by a photolithography process of using a photo mask (not shown) in which a flow channel structure of the ink chambers 104 having the coordinate disposition zigzagged or arranged in a straight line, the second ink supply channels 103 or the like is patterned.

As a result, as shown in FIG. 6D, on the protective layer 105 is formed a chamber plate 108. The chamber plate 108 provides the flow channel structure of the ink chambers 104, the second ink supply channels 103 or the like, later. Also, a thickness of the chamber plate 108 comes to a height of the ink chambers 104 and the second ink supply channels 103 to be formed later.

After forming the chamber plate 108 on the protective layer 105, as shown in FIG. 6E, a dry film resist is laminated on the chamber plate 108 with a heat and a pressure to form a dry film resist layer, and the dry film resist layer is exposed to light such as the UV and developed by a photolithography process of using a photo mask (not shown) in which a structure of the injection nozzles 107 having coordinate disposition zigzagged or arranged in a straight line, like as the ink chambers 104, is patterned. As a result, on the chamber plate 108 is formed a nozzle plate 109 having the injection nozzles 107 therein.

After forming the nozzle plate 109, to form a deep, second trench 102*b* constituting the second portion of the first ink supply channel 102, on a back surface of the substrate 101 is thickly coated with a second photo resist to form a second photo resist layer (not shown), and the second photo resist layer is exposed to light such as the UV and developed by a photolithography process of using a photo mask (not shown) having a second pattern of the second trench 102*b* which is equal to or smaller than the first pattern of the first trench 102*a*. As a result, on the back surface of the substrate 101 is formed a second trench-etching mask pattern (not shown).

Here, the second trench-etching mask pattern is explained as comprising a photo resist layer patterned through the photolithography process. However, it is to be understood that the layer may also comprise silicon oxide, nitride, epoxy resin film, pure metal film or the like formed by a vapor-depositing or sputtering, like the first trench-etching mask pattern.

After forming the second trench-etching mask pattern, the back surface of the substrate 101 is anisotropically etched toward the front surface of the substrate 101 by a silicon dry etching process of using the second trench-etching mask pattern as an etch mask. At this time, as an etching gas, a $SF_6$ gas is used. As a result, as shown in FIG. 6F, at the back surface of the substrate 101 is formed a deep, second trench 102*b* having the rest in depth of the substrate 101 except for the first trench 102*a* of 5-20 μm.

After an organic matter flowing into the back surfaces of the substrate 101 during the etching process and the second trench-etching mask pattern are removed, a flood-exposing process and a hard-baking process are performed with respect to the resultant substrate 101 respectively to enhance mechanical strength and corrosion resistance of the chamber and the nozzle plates 108, 109 and to adhere the chamber and the nozzle plates 108, 109 to the substrate 101 more closely, and the fabrication of the print head 100 is finally completed.

At this time, the flood-exposing process is carried out by exposing the resultant substrate 101 by a dose of UV ranging from several hundred $mJ/cm^2$ to several thousand $mJ/cm^2$, and the hard-baking process is carried out by baking the resultant substrate 101 for from several minutes to several ten minutes, for example 30 minutes at a temperature ranging from several ten ° C. to several hundred ° C., such as, for example 130-150° C.

EMBODIMENT 2

Figure 7A:
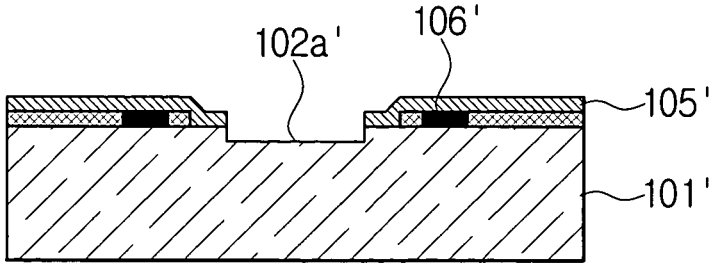
FIGS. 7A through 7F are views showing a process of fabricating a bubble-ink jet print head in accordance with a second embodiment of the present invention.
Figure 7B:
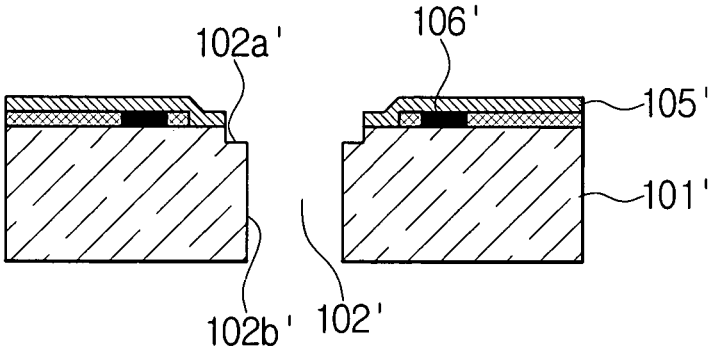
Figure 7C:
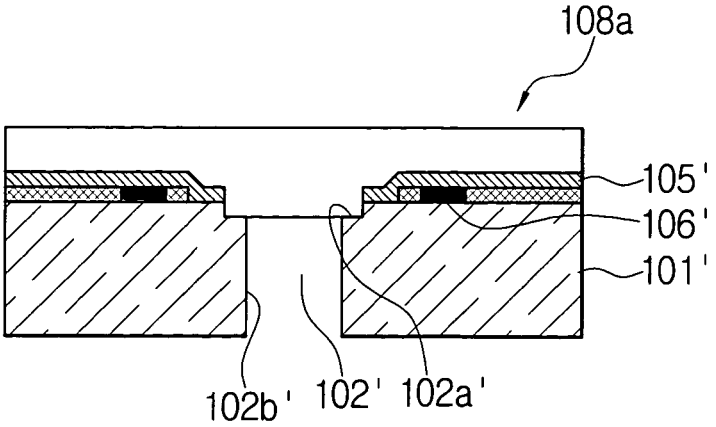
Figure 7D:
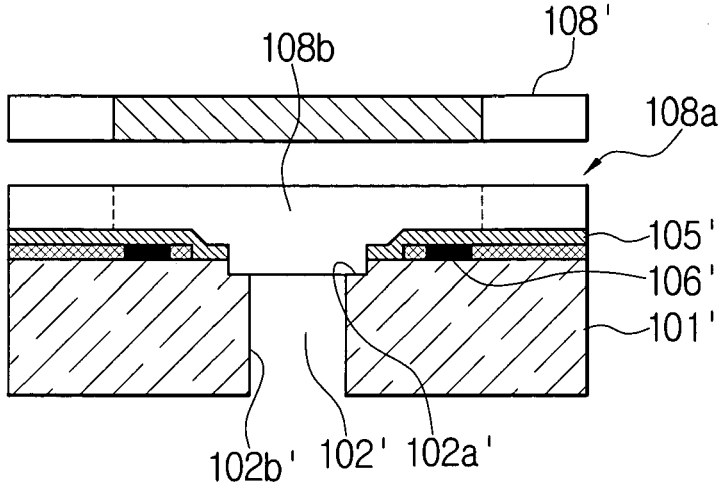
Figure 7E:
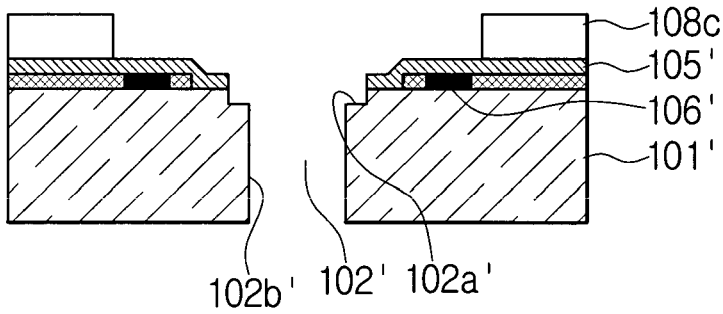
Figure 7F:
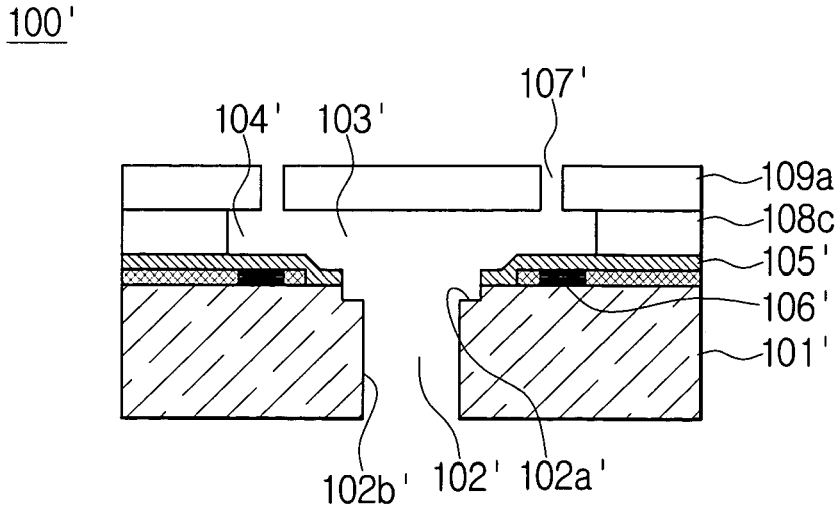

FIG. 7F shows a bubble-ink jet print head 100' according to a second embodiment of the present invention fabricated by an adhering method.

The print head 100' of this embodiment is similar to that of the first preferred embodiment explained with reference to FIG. 6F, except that a chamber plate 108*c* and *a* nozzle plate 109*a* are fabricated by the adhering method. Accordingly, a description about corresponding constructions of the print head 100' are omitted here.

A fabrication method of the adhering type bubble-ink jet print head 100' as constructed according to the second embodiment of the present invention will be described in detail with reference to FIGS. 7A through 7F.

Firstly, there is provided a silicon substrate 101' of 500-800 μm in thickness having switching elements (not shown) such as transistors and heaters 106' formed thereover.

Next, as shown in FIG. 7A, after forming a protective layer 105', a shallow first trench 102*a'* constituting a first portion of a first ink supply channel 102' is formed at a front surface of the silicon substrate 101' by a silicon dry etching process of using a first trench-etching mask pattern (not shown) as an etching mask, in the same manner as in the print head 100 of the first embodiment. The first trench 102*a'* has a depth of 5-20 μm and a separated distance SH ranging from 1 μm to 5 μm from inlets of ink chambers 104' to be formed later and/or connecting portions (not shown) between the adjacent ink chambers 104'.

Subsequently, to form a deep second trench 102*b'* constituting a second portion of the first ink supply channel 102', a back surface of the substrate 101' is anisotropically etched by a silicon dry etching process of using a second trench-etching mask pattern (not shown) formed in the same manner as in the print head 100 of the first embodiment as an etching mask. As a result, as shown in FIG. 7B, at the back surface of the substrate 101' is formed a deep, second trench 102*b'* constituting the first ink supply channel 102 together with a first trench 102*a'*. The second trench 102*b'* has an area equal to or smaller than that of the first trench 102*a'* and extends the rest of the depth of the substrate 101' except for the first trench 102*a'* of 5-20 μm.

After that, an organic matter flowing into the surfaces of the substrate 101' during the silicon dry etching process and the first and the second trench-etching mask patterns are removed.

And then, as shown in FIG. 7C, a dry film resist is laminated with a heat and a pressure over the whole front surface of the substrate 101' to form a dry film resist layer 108*a*. The dry film resist is comprised of a negative photo resist of resin material such as VACREL®, RISTON®, or the like of Dupont.

Subsequently, as shown in FIG. 7D, a UV exposing process is performed to the dry film resist layer 108*a*. The UV exposing process is carried out by using a photo mask 108' in which a flow channel structure of the ink chambers 104' and second ink supply channels 103' constituting restrictors is patterned. As a result, at the dry film resist layer 108*a* is formed a portion 108*b* which is not exposed to the UV and not hardened.

Thereafter, the non-hardened portion 108*b* of the dry film resist layer 108*a* is etched and removed by a developing process. As a result, over the front surface of the substrate 101' is formed a chamber plate 108*c* having the flow channel structure of the ink chamber 104', the second ink supply channels 103' or the like therein.

In this state, as shown in FIG. 7F, a nozzle plate 109*a* made of photo resist and so on or a polyimide film is adhered on chamber plate 108*c* by a heat and a pressure and the fabrication of the print head 100' is finally completed.

At this time, the nozzle plate made of the photo resist and so on is previously fabricated by an electrolytic deposition process of using a substrate (not shown) having a mandrel (not shown), and the nozzle plate of the polyimide film is previously fabricated to have ejection nozzles 107' formed therein by a laser ablation process.

EMBODIMENT 3

Figure 8A:
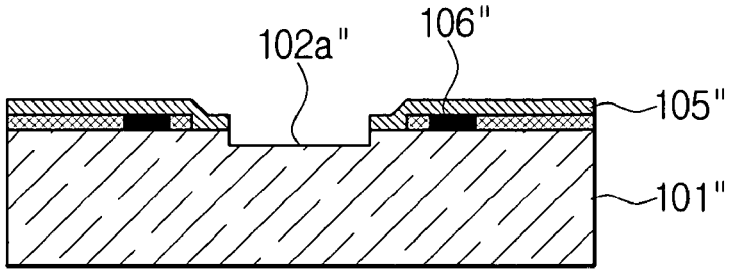
FIGS. 8A through 8J are views showing a process of fabricating a bubble-ink jet print head in accordance with a third embodiment of the present invention.
Figure 8B:
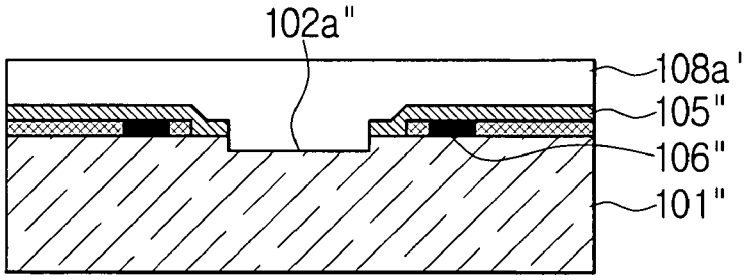
Figure 8C:
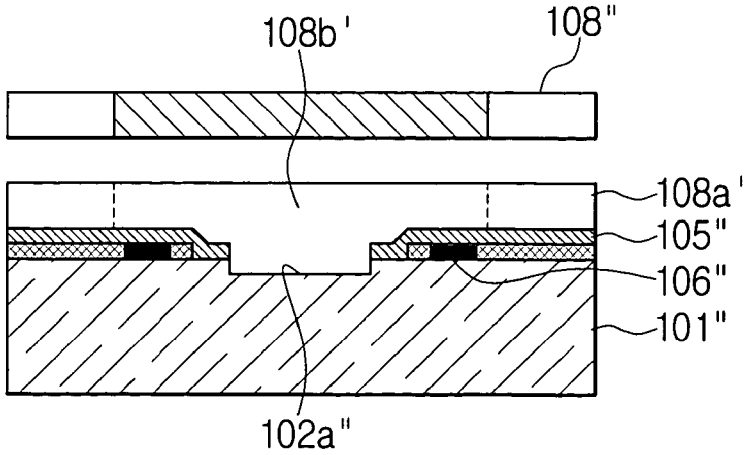
Figure 8D:
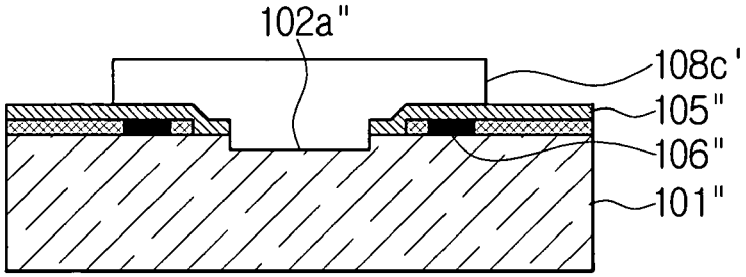
Figure 8E:
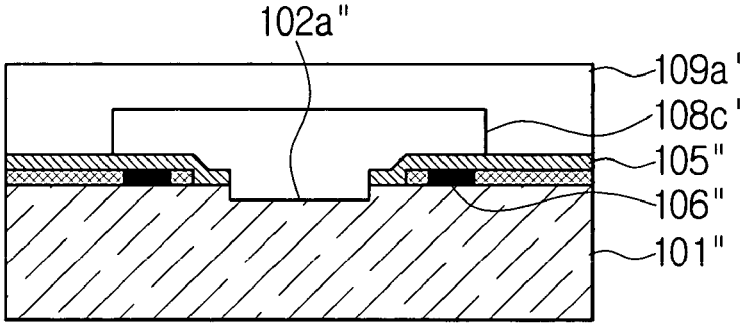
Figure 8F:
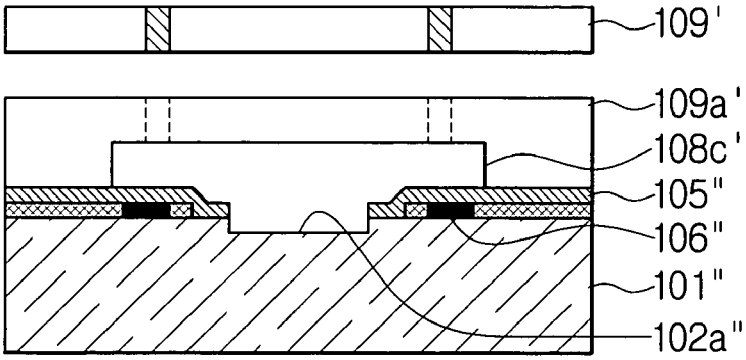
Figure 8G:
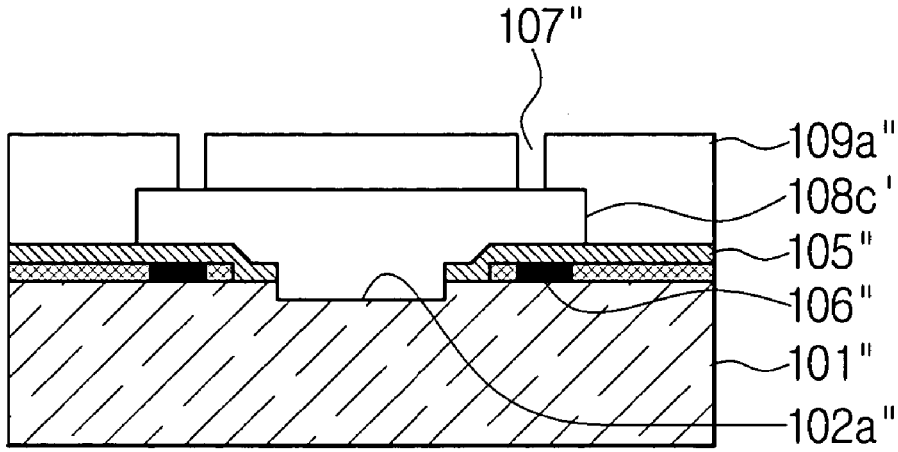
Figure 8H:
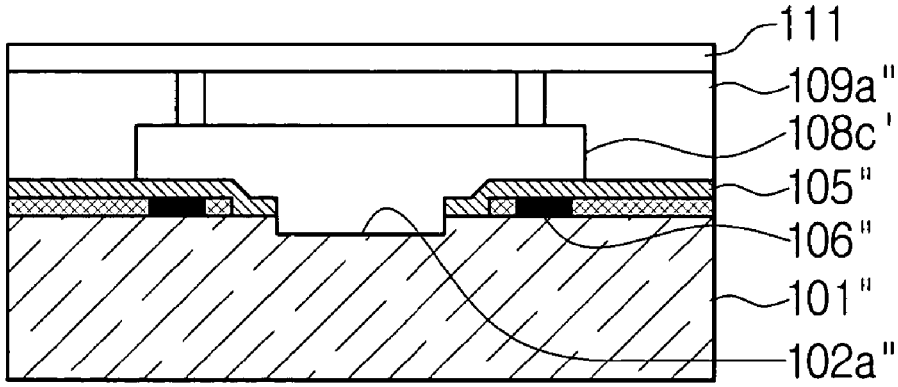
Figure 8I:
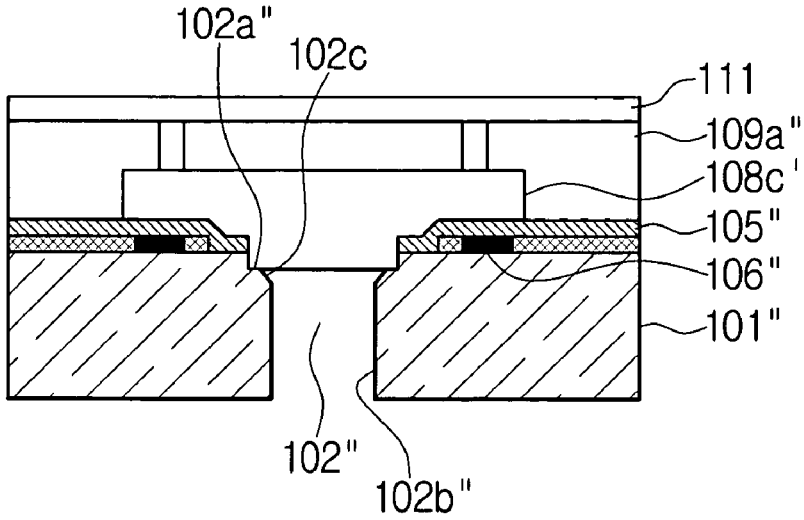
Figure 8J:
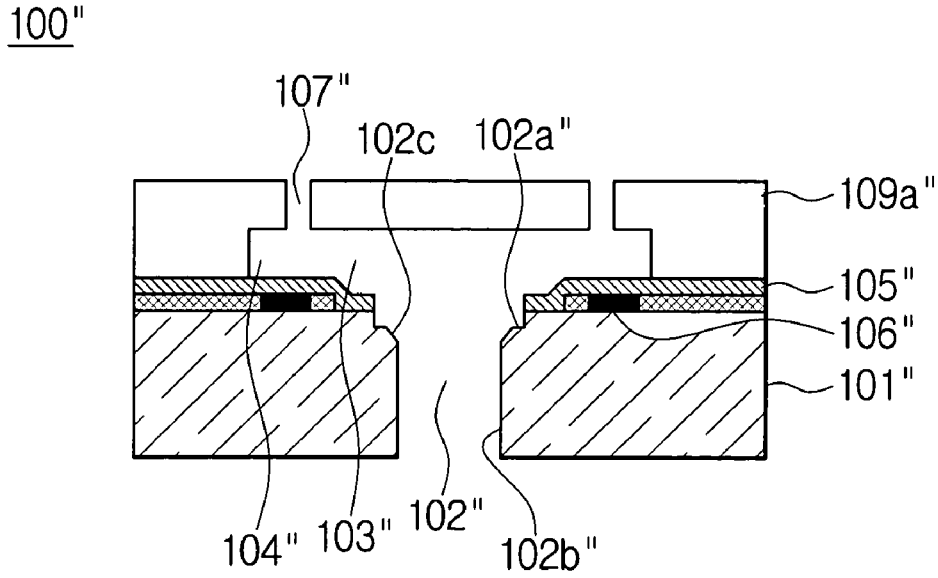

FIG. 8J shows a bubble-ink jet print head 100" according to a third embodiment of the present invention fabricated by a monolithic method.

The print head 100" of this embodiment is similar to those of the first and the second embodiments explained with reference to FIGS. 6F and 7F, except for having a chamber/nozzle plate 109*a*" of which a chamber plate defining ink chambers 104" and a nozzle plate defining injection nozzles 107" are fabricated in a body by the monolithic method. Accordingly, a description about corresponding constructions of the print head 100" is omitted.

A fabrication method of the monolithic bubble-ink jet print head 100" as constructed according to the third preferred embodiment of the present invention will be described in great detail with reference to FIGS. 8A through 8J.

Firstly, there is provided a silicon substrate 101" of 500-800 μm in thickness having switching elements (not shown) such as transistors and heaters 106" formed thereover.

Next, as shown in FIG. 8A, after forming a first protective layer 105", a shallow, first trench 102*a*" constituting a first portion of a first ink supply channel 102" is formed over a front surface of the silicon substrate 101" by a silicon dry etching process of using a first trench-etching mask pattern (not shown) as an etch mask, in the same manner as in the print head 100 of the first embodiment. The first trench 102*a*" have a depth of 5-20 μm and a separated distance SH ranging from 1 μm to 5 μm from inlets of the ink chambers 104" to be formed later and/or connecting portions (not shown) between the adjacent ink chambers 104".

Subsequently, an organic matter flowing into the front surfaces of the substrate 101" during the silicon dry etching process and the first trench-etching mask pattern are removed.

After that, as shown in FIG. 8B, a photo resist is coated in a thickness of several ten μm, for example 10-30 μm on the first protective layer 105" of the substrate 101 to form a first photo resist layer 108*a*', and the first photo resist layer 108*a*' is exposed to UV and developed by a photolithography process of using a photo mask 108", as shown in FIG. 8C.

As a result, as shown in FIG. 8D, on the first protective layer 105" is formed a photo resist mold 108*c*' as a sacrificial layer. The photo resist mold 108*c*' will be removed later to provide a flow channel structure of the ink chambers 104", second ink supply channels 103" or the like.

After forming the photo resist mold 108*c*' on the first protective layer 105", as shown in FIG. 8E, a photo resist of epoxy resin is coated over the whole front surface of the substrate 101" to form a second photo resist layer 109*a*'.

After that, as shown in FIG. 8F, the second photo resist layer 109*a*' is exposed to UV and developed by a photolithography process of using a photo mask 109' in which a structure of the injection nozzles 107" is patterned. As a result, as shown in FIG. 8G, a chamber/nozzle plate 109*a*" having the injection nozzles 107" therein is formed.

After the formation of the chamber/nozzle plate 109*a*", as shown in FIG. 8H, on the chamber/nozzle plate 109*a*" is formed a second protective layer 111 to protect the chamber/nozzle plate 109*a*" during following etching process for forming a second trench 102*b*" of the first ink supply channel 102".

Thereafter, as shown in FIG. 81, to form a deep, second trench 102*b*" constituting a second portion of the first ink supply channel 102", a back surface of the substrate 101" is anisotropically etched toward the front surface of the substrate 101" by a silicon dry etching process of using a second trench-etching mask pattern (not shown) formed in the same manner as the first trench-etching mask pattern (not shown) as an etching mask.

At this point, when a portion of the back surface of the substrate 101" exposed by the second trench-etching mask pattern is almost etched and removed, notches 102*c* are formed due to lateral etching generated as a result of charging phenomenon at the interface between the photo resist mold 108*c*' and the substrate 101". However, since the notches 102*c* are located at a middle of the first ink supply channel 102" apart from the ink chambers 104" by the first trench 102*a*" previously formed at the front surface of the substrate 101", they do not affect a flow of ink supplied to the injection nozzles 107" via the second ink supply channels 103" and the ink chambers 104" through the first ink supply channel 102" and a frequency characteristic of the injection nozzles 107" during printing.

Thus, after the silicon dry etching process is finished, at the exposed portion of the back surface of the substrate 101" is formed a deep, second trench 102*b*" constituting the first ink supply channel 102" together with the first trench 102*a*". The second trench 102*b*" has an area equal to or smaller than that of the first trench 102*a*" and the rest in depth of the substrate 101" except for the first trench 102*a*" of 5-20 μm.

Subsequently, an organic matter flowing into the back surfaces of the substrate 101" during the silicon dry etching process and the second trench-etching mask pattern are removed.

And then, after removing the second protective layer 111, the photo resist mold 108*c*" is dissolved and removed by a solvent. As a result, the flow channel structure of the ink chambers 104", the second ink supply channels 103" or the like is formed in the chamber/nozzle plate 109*a*", and the fabrication of the print head 100" is finally completed.

It is to be appreciated that the bubble-ink jet print head and the fabrication method thereof according to the above-described embodiments of the present invention can correctly and uniformly form the flow channel of ink supplied to the injection nozzles through the second supply channels and the ink chambers from the first ink supply channel connected with the ink cartridge, to improve uniformity in ink injection characteristics of the respective injection nozzles and thereby to assure amounts of ink supplied to or jetted through the respective injection nozzles to be the same with each other even though the injection nozzles are highly integrated.

Further, the bubble-ink jet print head and the fabrication method thereof according to the above-described embodiments of the present invention forms the first ink supply channel by etching two trenches having sizes different from each other through the dry and/or the wet etching processes at the front and the back surfaces of the substrate, and thereby can improve a drop in measure accuracy due to the notches generated when forming the first ink supply channel through only the dry etching process or the wet etching process at the back surfaces of the substrate.

Still further, the bubble-ink jet print head and the fabrication method thereof according to the above-described embodiments of the present invention can compensate for measuring error in etching of an inlet of the first ink supply channel and also enlarge process margin, by making an outlet of the first ink supply channel previously formed at the front surface of the substrate to have an area larger than that of the inlet of the first ink supply channel later formed at the back surface of the substrate, Furthermore, the bubble-ink jet print head and the fabrication method thereof according to the above-described embodiments of the present invention can improve efficiency and uniformity in ink jetting, by forming an outlet of the first ink supply channel closely to the ink chambers at the front surface of the substrate.

Moreover, the bubble-ink jet print head and the fabrication method thereof according to the above-described embodiments of the present invention is applicable irrespective of coordinate disposition of the injection nozzles and the ink chambers which is zigzagged or arranged in a straight line according to a resolution or a degree of which the injection nozzles are concentrated or integrated, thereby providing wide application.

Also, the bubble-ink jet print head and the fabrication method thereof according to the above-described embodiments of the present invention can prevent ink from being leaked in printing by reducing a size of inlet of the first ink supply channel formed at the back surface of the substrate to enlarge a contact area between the substrate and the ink cartridge.

Still also, the bubble-ink jet print head and the fabrication method thereof according to the above-described embodiments of the present invention provides a first ink supply channel which is applicable to both the fabrication method of the print head employing the monolithic method and the fabrication method of the print head employing the adhering method.

Although a few embodiments of the present invention have been shown and described, the present invention is not limited to the described embodiments. Rather, it would be appreciated by those skilled in the art that changes may be made in this embodiment without departing from the principles and spirit of the invention, the scope of which is defined in the claims and their equivalents.

What is claimed is:

1. A bubble-ink jet print head comprising:

a substrate having ink chambers to store ink and resistance heat emitting bodies to heat ink disposed thereover; and an ink supply passage which penetrates the substrate, extends beyond the substrate, and which is connected to the ink chambers, the ink supply passage including:

a first trench formed at a first surface of the substrate in a first pattern having a separating distance from at least one of inlets of the ink chambers and connecting portions between the adjacent ink chambers, the first surface of the substrate having the ink chambers disposed thereover, and a second trench formed at a second surface of the substrate in a second pattern, having an area equal to or smaller than that of the first trench in the range of the first pattern of the first trench, having a uniform width, penetrating the substrate and directly connected to the first trench, wherein the first trench has a depth from 5 μm to 20 μm.

2. A bubble-ink jet print head comprising:

a substrate having ink chambers to store ink and resistance heat emitting bodies to heat ink disposed thereover; and an ink supply passage which penetrates the substrate, extends beyond the sUbstrate, and which is connected to the ink chambers, the ink supply passage including:

a first trench formed at a first surface of the substrate in a first pattern having a separating distance from at least one of inlets of the ink chambers and connecting portions between the adjacent ink chambers, the first surface of the substrate having the ink chambers disposed thereover, and a second trench formed at a second surface of the substrate in a second pattern, having an area equal to or smaller than that of the first trench in the range of the first pattern of the first trench, having a uniform width, penetrating the substrate and directly connected to the first trench, wherein the separating distance is from 1 μm to 5 μm.

3. An ink-jet print head, comprising:

a substrate;

at least one heater formed on a top surface of the substrate which heats ink disposed;

a protective layer formed on the at least one heater;

an ink chamber disposed at least partially over the protective layer; and an ink supply opening extending through the substrate and the protective layer, the ink passage in fluidic communication with the ink supply chamber and the ink chamber, the ink supply opening including a first trench formed at an ink chamber side of the substrate in a first pattern having a separated distance from at least one of inlets of the ink chambers and connecting portions between the adjacent ink chambers, and a second trench formed at a second surface of the substrate in a second pattern, having an area equal to or area smaller than that of the first trench in the range of the first pattern of the first trench, having a uniform width, penetrating the substrate and directly connected to the first trench, wherein the first trench has a depth from 5 μm to 20 μm.

* * * * *

UNITED STATES PATENT AND TRADEMARK OFFICE

CERTIFICATE OF CORRECTION

PATENT NO. : 7,320,513 B2
APPLICATION NO. : 10/751467
DATED : January 22, 2008
INVENTOR(S) : Yun-gi Kim et al.

It is certified that error appears in the above-identified patent and that said Letters Patent is hereby corrected as shown below:

Column 14, Line 22, change "sUbstrate," to --substrate,--.

Signed and Sealed this

Twenty-fourth Day of June, 2008

JON W. DUDAS
*Director of the United States Patent and Trademark Office*